US010252432B2

(12) United States Patent
Nakasuka

(10) Patent No.: US 10,252,432 B2
(45) Date of Patent: Apr. 9, 2019

(54) RAZOR HAVING ATTACHED SHAVING AID

(71) Applicant: KAIR R&D CENTER CO., LTD., Seki-shi, Gifu-ken (JP)

(72) Inventor: Hiroyuki Nakasuka, Seki (JP)

(73) Assignee: KAI R&D CENTER CO., LTD. (JP)

( * ) Notice: Subject to any disclaimer, the term of this patent is extended or adjusted under 35 U.S.C. 154(b) by 3 days.

(21) Appl. No.: 15/324,965

(22) PCT Filed: Jul. 29, 2015

(86) PCT No.: PCT/JP2015/071523

§ 371 (c)(1),
(2) Date: Jan. 9, 2017

(87) PCT Pub. No.: WO2016/017703

PCT Pub. Date: Feb. 4, 2016

(65) Prior Publication Data

US 2017/0203452 A1 Jul. 20, 2017

(30) Foreign Application Priority Data

Jul. 31, 2014 (JP) ..... 2014-155663

(51) Int. Cl.
*B26B 21/44* (2006.01)
*B26B 21/06* (2006.01)
*B26B 21/22* (2006.01)

(52) U.S. Cl.
CPC ..... *B26B 21/44* (2013.01); *B26B 21/06* (2013.01); *B26B 21/227* (2013.01)

(58) Field of Classification Search
CPC ..... B26B 21/44; B26B 21/443; B26B 21/446; B26B 19/40
(Continued)

(56) References Cited

U.S. PATENT DOCUMENTS 4,586,255 A 5/1986 Jacobson
5,134,775 A * 8/1992 Althaus ..... B26B 21/44 30/41
(Continued)

FOREIGN PATENT DOCUMENTS

EP 1990143 A1 11/2008
JP 62-500494 A 3/1987
(Continued)

OTHER PUBLICATIONS

International Preliminary Report on Patentability for Application No. PCT/JP2015/071523 dated Jan. 31, 2017.
(Continued)

*Primary Examiner* — Laura M Lee
(74) *Attorney, Agent, or Firm* — Tarolli, Sundheim, Covell & Tummino LLP

(57) ABSTRACT

In a razor having a blade body assembling portion provided with a blade support supporting a blade body and a shaving aid, the blade support is provided with an outer frame portion, to which the shaving aid is attached. The shaving aid is protruded from the outer frame portion. The shaving aid has a deformable portion, which is provided in a cantilever manner. The deformable portion is deformable along with contact with a skin surface during use. A protruding edge portion provided in the deformable portion is exposed to the outside in a protruding direction of the shaving aid.

5 Claims, 9 Drawing Sheets

(58) Field of Classification Search
USPC ..... 30/538
See application file for complete search history.

(56) References Cited

U.S. PATENT DOCUMENTS

| | | | | |
|---|---|---|---|---|
| 5,551,153 | A * | 9/1996 | Simms | B26B 21/227 30/346.59 |
| 9,498,892 | B2 * | 11/2016 | Nakasuka | B26B 21/225 |
| 2006/0080837 | A1 * | 4/2006 | Johnson | B26B 21/44 30/50 |
| 2008/0209734 | A1 * | 9/2008 | Nicoll | B26B 21/222 30/41 |
| 2010/0122464 | A1 | 5/2010 | Ndou et al. | |
| 2011/0247217 | A1 * | 10/2011 | Johnson | B26B 21/225 30/50 |
| 2012/0216408 | A1 | 8/2012 | Cook et al. | |
| 2015/0290820 | A1 | 10/2015 | Haba | |

FOREIGN PATENT DOCUMENTS

| | | | | |
|---|---|---|---|---|
| JP | 2012-508086 | A | 4/2012 | |
| JP | 4921747 | B2 | 4/2012 | |
| JP | WO 2012157624 | A1 * | 11/2012 | B26B 21/225 |
| JP | 2013-542811 | A | 11/2013 | |
| JP | 2014-90932 | A | 5/2014 | |
| WO | 2001060573 | A1 | 8/2001 | |
| WO | 2011130075 | A1 | 10/2011 | |

OTHER PUBLICATIONS

International Search Report for Application No. PCT/JP2015/071523 dated Sep. 29, 2015.

European Search Report corresponding to European Application No. EP15827040.5, dated Jan. 17, 2018, pp. 1-7.

* cited by examiner

RAZOR HAVING ATTACHED SHAVING AID

RELATED APPLICATIONS

The present invention is a U.S. National Stage under 35 USC 371 patent application, claiming priority to Serial No. PCT/2015/071523, filed on 29 Jul. 2015; which claims priority from JP 2014-155663, filed 31 Jul. 2014, the entirety of both of which are incorporated herein by reference.

BACKGROUND OF THE INVENTION

The present invention relates to a razor with a shaving aid capable of shaving skin hair growing on various parts of a body.

In the following Patent Document 1, a base member having a shaving aid is supported to be rotational with respect to a blade body assembling member and is held by an elastic force of a leaf spring and swings against the elastic force during use to lessen shaving resistance due to contact between the shaving aid and a skin surface.

PRIOR ART DOCUMENTS

Patent Documents

Patent Document 1: Japanese Patent No. 4921747

Patent Document 2: Japanese Laid-Open Patent Publication No. 2014-90932

SUMMARY OF INVENTION

However, the razor according to Patent Document 1 has a support structure, in which the base member is rotationally supported by the blade body assembling member and held by the leaf spring, the number of parts is increased and the assembling work of the base member to the blade body assembling member is required. This increases the manufacturing costs. In this connection, the present applicant has already filed a patent application of Patent Document 2. The present application is configured to further improve the razor according to Patent Document 2.

It is an objective of the present invention to simplify, in a razor provided with a shaving aid, the support structure of the shaving aid that improves shaving sensation during use.

To achieve the foregoing objective, in a razor with a shaving aid according to the present invention, a blade support supporting a blade body and a shaving aid are provided to a blade body assembling portion, and an attachment portion, to which the shaving aid is attached, is provided to the blade support. The shaving aid is protruded from the attachment portion, and the shaving aid itself is provided with a deformable portion, which is deformed by contact with a skin surface during use. The deformable portion has a protruding edge portion, which is opened in a protruding direction of the shaving aid and exposed to the outside.

Thus, the shaving aid itself is deformed at the deformable portion, and shaving resistance due to contact between the deformable portion of the shaving aid and the skin surface is lessened during use. Therefore, the tactile sensation on the skin surface is improved to improve the shaving sensation, and the support structure of the shaving aid is simplified. Further, there is no need to provide a frame portion supporting the protruding edge portion of the deformable portion, and the protruding edge portion is opened and exposed. Accordingly, the deformable portion is more easily deformed when the protruding edge portion is brought into contact with the skin surface, thereby making the tactile sensation on the skin surface much better and improving the shaving sensation.

The deformation of the deformable portion refers to deformation restored after the deformable portion is bent under a bending force as a deformation force, deformation restored after the deformable portion is dented under a compressive force as the deformation force, or a deformation caused by a bending force and a compressive force.

In the above described configuration, front and back surfaces are preferably exposed in a thickness direction, which is orthogonal to the protruding direction of the shaving aid. The front surface is continuous with the protruding edge portion on a front side of the razor, and a cutting edge of the blade body is preferably exposed on the front surface in the blade support. The back surface is continuous with the protruding edge portion on a back side, which is opposite to the front side, and is preferably exposed.

In this case, the front surface and the back surface, which are continuous with the protruding edge portion, are preferably exposed in the deformable portion. Therefore, the tactile sensation on the skin surface is further improved to improve the shaving sensation when the protruding edge portion of the deformable portion and the front surface are brought into contact with the skin surface. At that time, the deformable portion is restored after being bent under, for example, a bending force as the deformation force, and accordingly, the tactile sensation on the skin surface is further improved to improve the shaving sensation.

The deformable portion of the shaving aid is preferably provided in a cantilever manner to allow for bending in a thickness direction of the shaving aid. In this case, the deformable portion is bent more easily, so that the tactile sensation on the skin surface is further improved to improve the shaving sensation.

Between the attachment portion of the blade support and the protruding edge portion of the deformable portion, the deformable portion of the shaving aid is preferably provided with a base adjacent to the attachment portion and a tip portion including the protruding edge portion. The tip portion is preferably provided to be bent in the thickness direction of the shaving aid more easily than the base.

In this case, the tip portion is bent more easily than the base in the deformable portion. Therefore, the tactile sensation on the skin surface is further improved to improve the shaving sensation when the deformable portion, in particular the tip portion thereof, is brought into contact with the skin surface.

The thickness of the tip portion is preferably made smaller than that of the base in the thickness direction of the shaving aid. In this case, the tip portion can be bent more easily than the base in the deformable portion.

A step portion is preferably provided, for example, on the back surface at a boundary between the base and the tip portion in the deformable portion. In this case, the tip portion can be bent more easily than the base in the deformable portion.

Front and back surfaces are exposed in a thickness direction, which is orthogonal to the protruding direction of the shaving aid, and the front surface is continuous with the protruding edge portion on a front side of the razor, and a cutting edge of the blade body is exposed in the blade support on the front surface. The blade body assembling portion preferably includes a placement portion. The placement portion supports the back surface continuous with the protruding edge portion on a back side, which is opposite to the front side. The placement portion is protruded from the attachment portion of the blade support. The front surface is continuous with the protruding edge portion and is exposed in the deformable portion. Accordingly, the tactile sensation on the skin surface is further improved to improve the shaving sensation when the protruding edge portion of the deformable portion and the front surface are brought into contact with the skin surface. At that time, the deformable portion is restored after being dented under, for example, a compressive force as the deformation force. Thus, the tactile sensation on the skin surface is further improved to improve the shaving sensation.

The deformable portion of the shaving aid preferably includes an elastic material. For example, the shaving aid is molded including a water-soluble component and a water-insoluble component including the elastic material. In this case, the deformable portion can be elastically deformed easily.

Of front and back surfaces in a thickness direction orthogonal to the protruding direction of the shaving aid, the front surface is a front side, where a cutting edge of the blade body is exposed in the blade support. The front surface is preferably curved to approach the back surface as the distance from the protruding edge portion decreases. In this case, the deformable portion is more easily brought into contact with the skin surface, and the tactile sensation on the skin surface is further improved to improve the shaving sensation. For example, a narrow part and a small part such as armpits, bikini lines, and the like are also easily shaved.

A holder has a grip portion and a top portion located at an upper end of the grip portion. The blade body assembling portion is preferably attached pivotally to the top portion. Of a front side of the top portion facing the back side of the blade support, which is opposite to the front side of the blade support, and a back side of the top portion, which is opposite to the front side of the top portion, the top portion is curved from the front side to the back side with respect to the grip portion.

In this case, the blade body assembling portion can pivot with respect to the top portion of the holder. Accordingly, the tactile sensation on the skin surface is further improved to improve the shaving sensation when the shaving aid of the blade body assembling portion is brought into contact with the skin surface. The curvature of the top portion of the holder prevents the blade body assembling portion and the shaving aid thereof from hitting against the top portion at the time of pivoting, whereby the pivoting can be carried out smoothly.

It is preferable that the protruding direction of the shaving aid is orthogonal to a thickness direction of the shaving aid and is along an extending direction of the cutting edge of the blade body or a direction orthogonal to the extending direction of the cutting edge. In this case, the deformable portion can be easily contacted with the skin surface when the blade support is applied on the skin surface.

The attachment portion of the blade support is preferably provided on a side opposite to a cutting edge of the blade body. In this case, for example, the shaving aid is protruded away from the cutting edge of the blade body in the direction orthogonal to the thickness direction of the shaving aid and orthogonal to the extending direction of the cutting edge of the blade body. In this case, the deformable portion is more easily contacted with the skin surface at the time of shaving the skin surface by the blade support.

The distance between the protruding edge portion of the deformable portion and the attachment portion of the blade support is preferably set narrower toward both sides in an extending direction of a cutting edge of the blade body. In this case, an area where a central part of the deformable portion contacts the skin surface becomes large. Thus, the tactile sensation on the skin surface is further improved to improve the shaving sensation.

Of the front and back surfaces in a thickness direction orthogonal to the protruding direction of the shaving aid, the front surface, which is a front side, where the cutting edge of the blade body is exposed in the blade support, is provided with a recess. In this case, moisture is easily retained in the recess. Therefore, lubricity is increased and the tactile sensation on the skin surface is further improved. This improves the shaving sensation.

Of the front and back surfaces in a thickness direction orthogonal to the protruding direction of the shaving aid, the protruding edge portion is preferably provided with a chamfered portion on the front surface, which is a front side, where a cutting edge of the blade body is exposed in the blade support. In this case, the chamfered portion of the protruding edge portion makes the tactile sensation on the skin surface much better to improve the shaving sensation when the protruding edge portion is brought into contact with the skin surface.

The razor provided with the shaving aid of the present invention has a simplified support structure and an improved shaving sensation during use.

DETAILED DESCRIPTION OF THE PREFERRED EMBODIMENTS

First, a first embodiment of the present invention will be described with reference to FIGS. 1 to 3 and FIG. 4A.

Figure 1B:
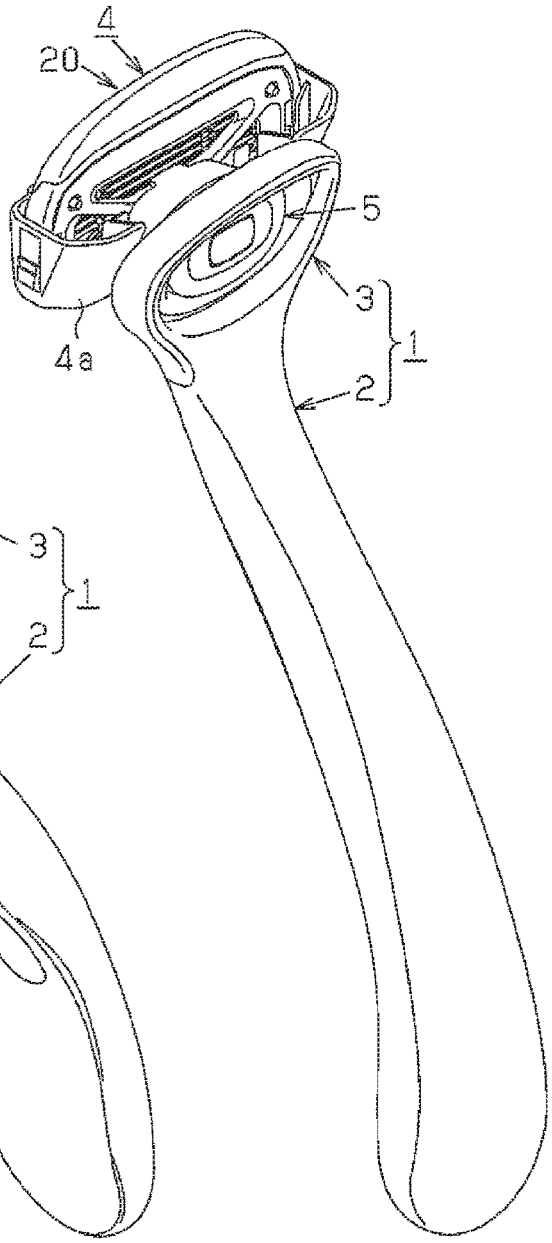
FIG. 1B is an overall perspective view of the same as viewed from the back.
Figure 1A:
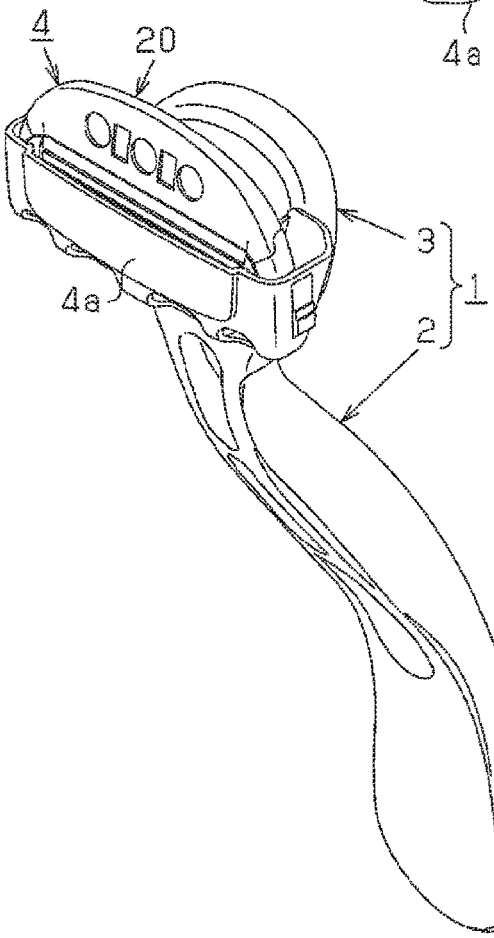
FIG. 1A is an overall perspective view of a pivoting razor according to a first embodiment as viewed from front, showing a state in which a cap is attached in a neutral position of a razor head.

A holder 1 has a grip portion 2 and a top portion 3 located at the upper end of the grip portion 2 as shown in FIGS. 1A and 1B. A razor head 4 is attached to the front side of the top portion 3 by a pivot mechanism 5. A cap 4*a* is detachably fitted upward from bottom to the lower side of the razor head 4.

Figure 2B:
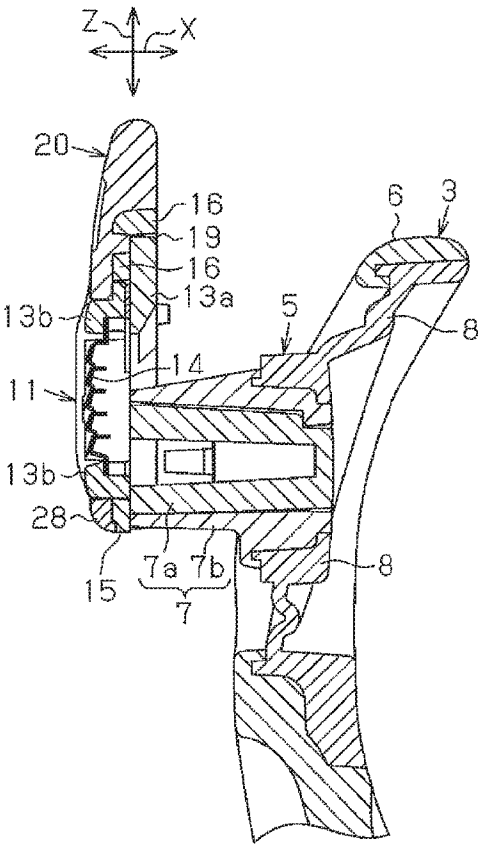
FIG. 2B is a partially enlarged sectional view of the same as viewed from the side.
Figure 2A:
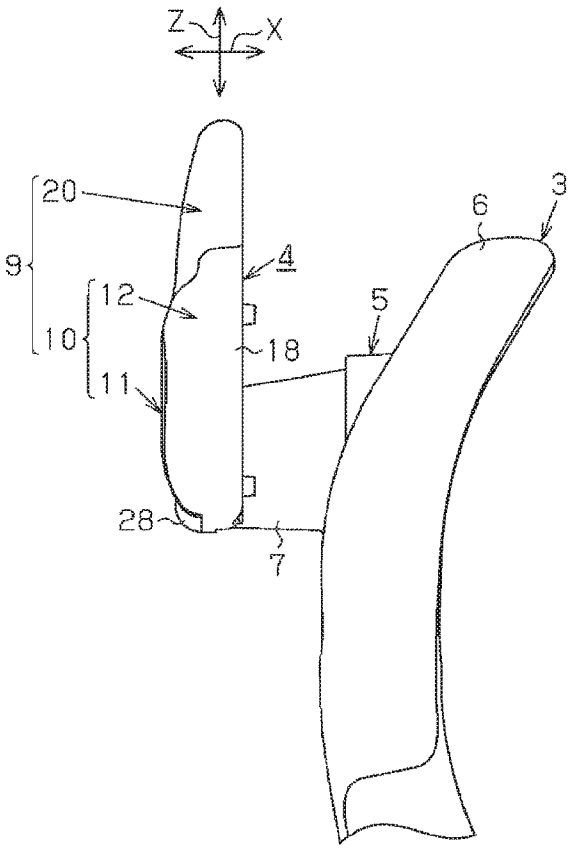
FIG. 2A is a partially enlarged side view showing a top portion of a holder and the razor head in the pivoting razor shown in FIGS. 1A and 1B.
Figure 3A:
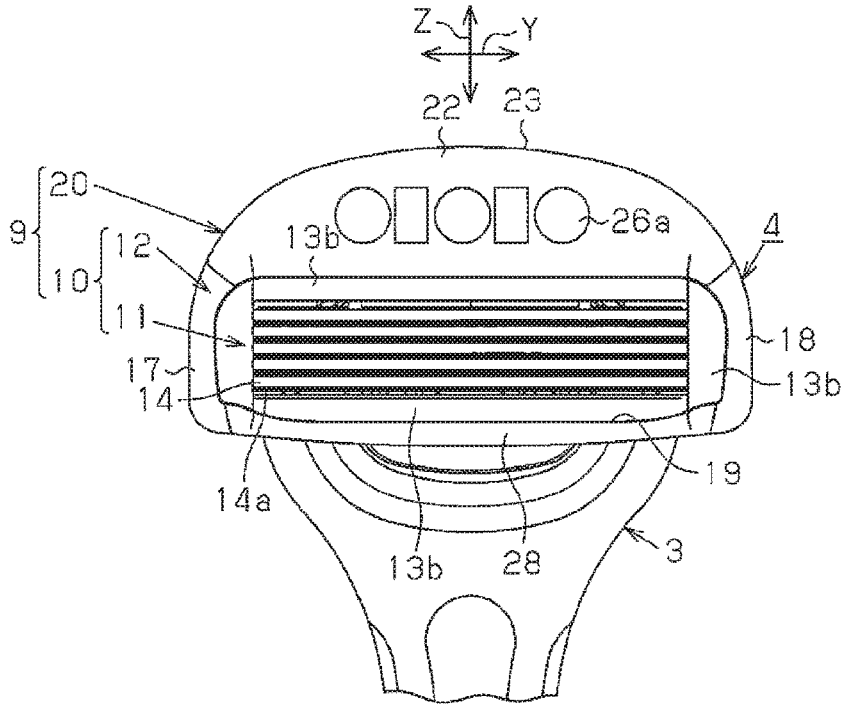
FIG. 3A is a partially enlarged front view showing the top portion of the holder and the razor head in the pivoting razor shown in FIGS. 1A and 1B.
Figure 3B:
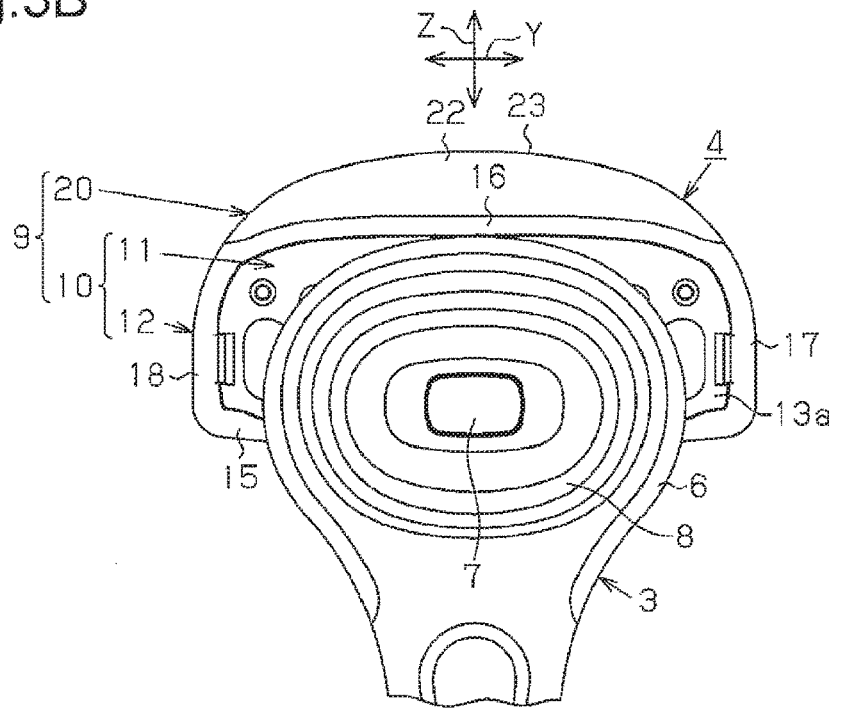
FIG. 3B is a partially enlarged back view of the same.

In the pivot mechanism 5, an annular elastic portion 8 is located between an annular support portion 6 located at the top portion 3 of the holder 1 and a supported portion 7 located on the razor head 4, as shown in FIGS. 2A and 2B. Due to a shaving force, the razor head 4 is moved from the neutral position to a pivoted position, which is tilted in any direction including a direction toward the front of the top portion 3, against an urging force of the elastic portion 8. Removal of the shaving force returns the razor head 4 to the neutral position from the pivoted position by the urging force of the elastic portion 8.

As shown in FIGS. 2A, 2B, 3A and 3B, the razor head 4 has a blade body assembling portion 9, which includes a blade support 10. The blade support 10 is formed by a main body portion 11 and a frame body portion 12. A plurality of blade bodies 14 are assembled between a base portion 13*a* and a covering portion 13*b* in the main body portion 11 of the blade support 10. The supported portion 7 has a connecting portion 7*a* protruded from the base portion 13*a* and a connecting portion 7*b* attached to the elastic portion 8, and the connecting portions 7*a*, 7*b* are inserted and attached to each other.

On the upper and lower sides in the vertical direction Z, which is orthogonal to an extending direction Y (the left-right direction) of a cutting edge 14*a* of each blade body 14, the frame body portion 12 of the blade support 10 has a lower outer frame portion 15 located on the side to which the cutting edges 14*a* are directed, an upper outer frame portion 16 located on the side opposite to the cutting edges 14*a*. The frame body portion 12 also has a left outer frame portion 17 and a right outer frame portion 18 connecting the lower outer frame portion 15 and the upper outer frame portion 16 with each other on the opposite sides in the extending direction Y of the cutting edges 14*a*, and an opening 19 surrounded by these outer frame portions 15, 16, 17, 18 and opened in the front-back direction X. The main body portion 11 of the blade support 10 is fitted into the opening 19, and an outer periphery connecting the lower, upper, left, and right sides of the main body portion 11 together is surrounded by the outer frame portions 15, 16, 17, 18. The cutting edge 14*a* of each blade body 14 is exposed forward in the opening 19.

In addition to the foregoing blade support 10, the blade body assembling portion 9 in the razor head 4 includes a shaving aid 20 integrally attached to the upper outer frame portion 16 in the frame body portion 12 by injection molding, as shown in FIGS. 2A, 2B, 3A, and 3B. The shaving aid 20 is molded to include a water-soluble component such as water-soluble polyethylene oxide and a water-insoluble component including soft plastic such as elastomer resin as an elastic material. The weight proportion of the soft resin in the water-insoluble component in relation to the weight of the entire shaving aid 20 is set larger than the weight proportion of the water-soluble component in relation to the weight of the entire shaving aid 20. The elastomer resin is set to have a weight proportion of not less than 30% (a weight proportion of 50% or larger in the present embodiment), and the water-soluble component is set to have a weight proportion of not more than 50% (a weight proportion of 15% in the present embodiment). The blade support 10 and the shaving aid 20 of the blade body assembling portion 9 and the supported portion 7 are molded from resin in the razor head 4, except for the blade bodies 14 of the main body portion 11.

Figure 4B:
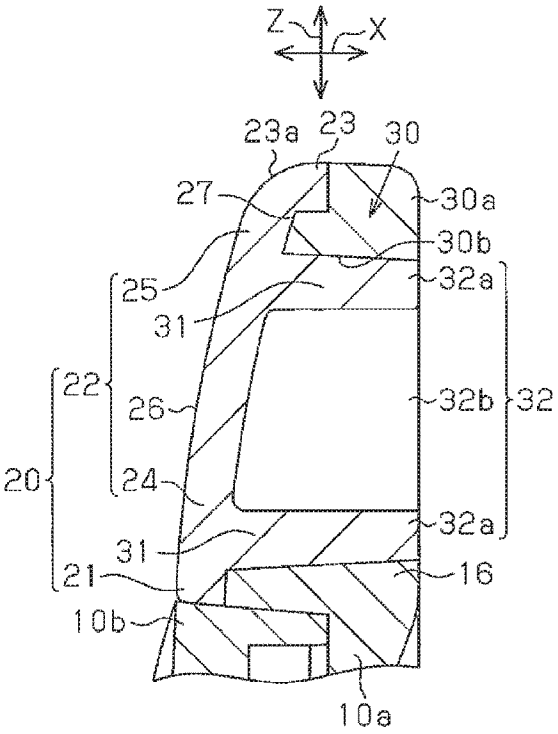
FIG. 4B is a partially enlarged longitudinal sectional view showing only the upper shaving aid in FIG. 9B.
Figure 4A:
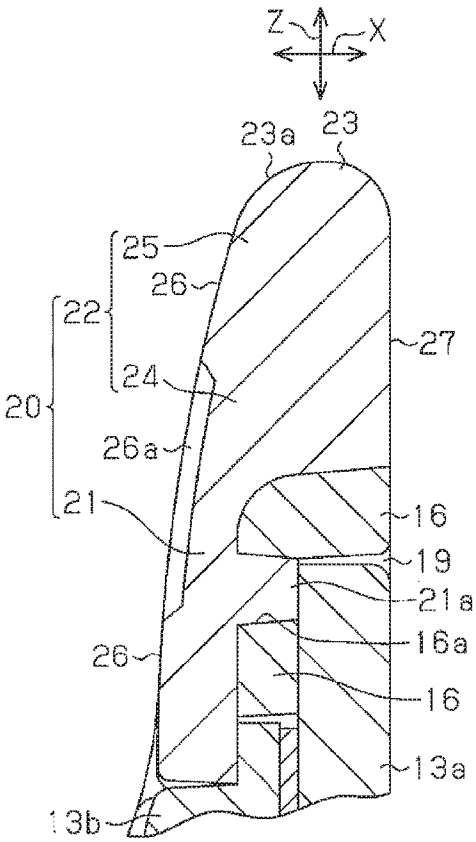
FIG. 4A is a partially enlarged longitudinal sectional view showing only the upper shaving aid in FIG. 3B.

As shown in FIG. 4A, the shaving aid 20 has a fixing portion 21 and a deformable portion 22, which is protruded upward in a cantilever manner from the fixing portion 21. The fixing portion 21 is protruded from the upper outer frame portion 16 (an attachment portion) of the frame body portion 12 upward away from the cutting edges 14*a* in the vertical direction (a protruding direction Z), which is orthogonal to the extending direction Y of the cutting edges 14*a*. The fixing portion 21 is attached to the upper outer frame portion 16 on the front side of the blade support 10, where the cutting edges 14*a* are exposed. The fixing portion 21 has a molded protrusion 21*a*, which is inserted and attached to a retaining hole 16*a* formed in the upper outer frame portion 16.

The deformable portion 22 includes a base 24 and a tip portion 25. The base 24 is located between a protruding edge portion 23 of the deformable portion 22 and a portion that includes the upper outer frame portion 16 and a fixing portion 21, and is adjacent to the upper outer frame portion 16 and the fixing portion 21. The tip portion 25 includes the protruding edge portion 23. The deformable portion 22 can be elastically deformed by contact with a skin surface and bent in the front-back direction (the thickness direction X), which is orthogonal to the protruding direction Z, during use. The entire protruding edge portion 23 of the deformable portion 22 is opened and exposed to the outside in the protruding direction Z, and is bulged and curved upward. In the fixing portion 21 and deformable portion 22 of the shaving aid 20, an entire front surface 26, which is continuous with the protruding edge portion 23 on the front side, where the cutting edges 14*a* are located, is exposed to the outside in the thickness direction X thereof.

In the deformable portion 22, an entire back surface 27, which is continuous with the protruding edge portion 23 on the back side, which is opposite to the front side, is exposed to the outside in the thickness direction X thereof. In the deformable portion 22, the distance of the protruding edge portion 23 to the upper outer frame portion 16 in the protruding direction Z is set to be decreased toward the opposite sides in the extending direction Y of the cutting edges 14*a*, and the entire protruding edge portion 23 is bulged and curved upward. The protruding edge portion 23 is formed with a chamfered portion 23*a*, which is smoothly continuous with the front surface 26 and back surface 27 of the deformable portion 22. The shaving aid 20 has a recess 26*a* on the front surface 26. The recess 26*a* extends throughout the fixing portion 21 to the deformable portion 22. The recess 26*a* can be used as a marking that shows a geometrical pattern, the product name, the brand name, or the manufacturer's name.

The thickness of the tip portion 25 is made smaller than that of the base 24 in the deformable portion 22 so that the tip portion 25 is configured to be bent more easily than the base 24. Toward the protruding edge portion 23, the front surface 26 of the deformable portion 22 is curved toward the back surface 27 of the deformable portion 22. In the present embodiment, the radius of curvature of the front surface 26 is set to about 30 mm, which is within a preferred range from 20 to 100 mm. The top portion 3 has a front side, which faces the back side of the blade support 10, and a back side, which is a side opposite to the front side. The top portion 3 is curved with respect to the grip portion 2.

Another shaving aid 28 is injection-molded to the lower outer frame portion 15 together and simultaneously with the shaving aid 20 of the upper outer frame portion 16, and integrally attached to the frame body portion 12 of the blade support 10.

Next, operation of the razor will be described focusing on features of the shaving aids 20, 28.

When the razor head 4 in the neutral position during use is pressed on a skin surface to shave skin hair, the razor head 4 is tilted according to the pressed direction against the urging force of the elastic portion 8 of the pivot mechanism 5, and resistance in shaving skin hair is lessened. Since the shaving aids 20, 28 of the razor head 4 are applied to the skin surface while containing moisture, sliding of the razor head 4 is facilitated and shaving sensation is improved. The deformable portion 22 of the shaving aid 20 is not only bent in the thickness direction X and elastically deformed by contact with the skin surface, but also the protruding edge portion 23 thereof is open and exposed to the outside in the protruding direction Z. Also, the front surface 26, which is continuous with the protruding edge portion 23, is opened and exposed to the outside in the thickness direction X. Therefore, the tactile sensation on the skin surface is improved.

Figure 5B:
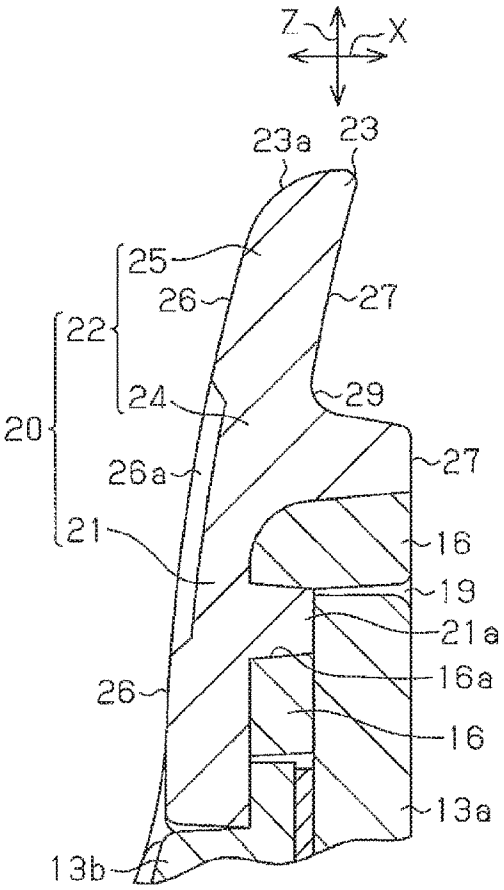
FIG. 5B is a partially enlarged longitudinal sectional view showing only an upper shaving aid in FIG. 5A.
Figure 5A:
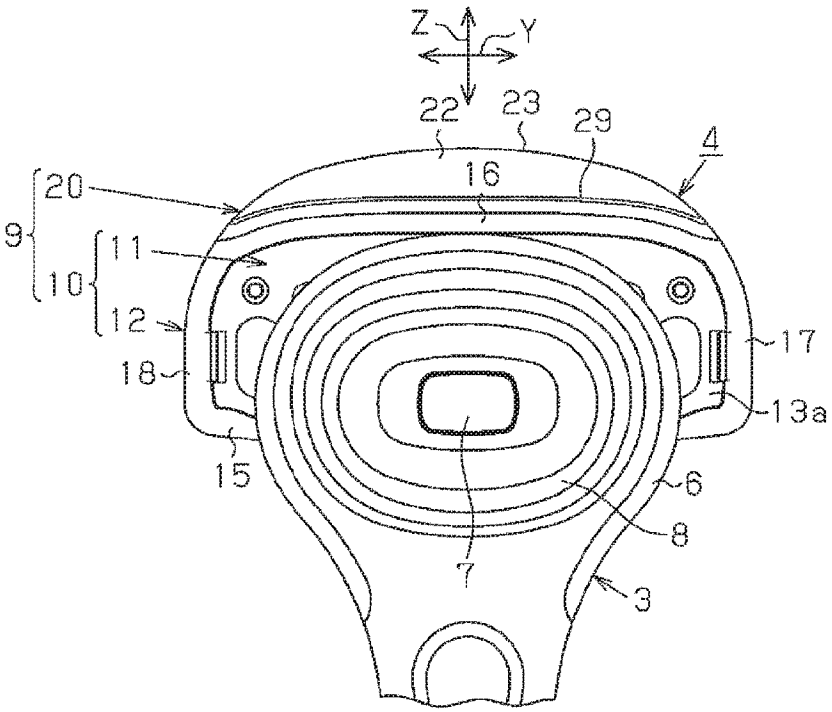
FIG. 5A is a partially enlarged back view showing a top portion of a holder and a razor head in a pivoting razor according to a second embodiment.

A second embodiment shown in FIGS. 5A and 5B mainly differs from the first embodiment in that a step portion 29 is formed at a boundary between the base 24 and the tip portion 25 on the back surface 27 of the deformable portion 22. The thickness of the tip portion 25 is thus made much smaller than that of the base 24, and the tip portion 25 is bent more easily than the base 24. Further, a partially enlarged front view showing the top portion 3 of the holder 1 and the razor head 4 is identical to FIG. 3A in the first embodiment.

Figure 6B:
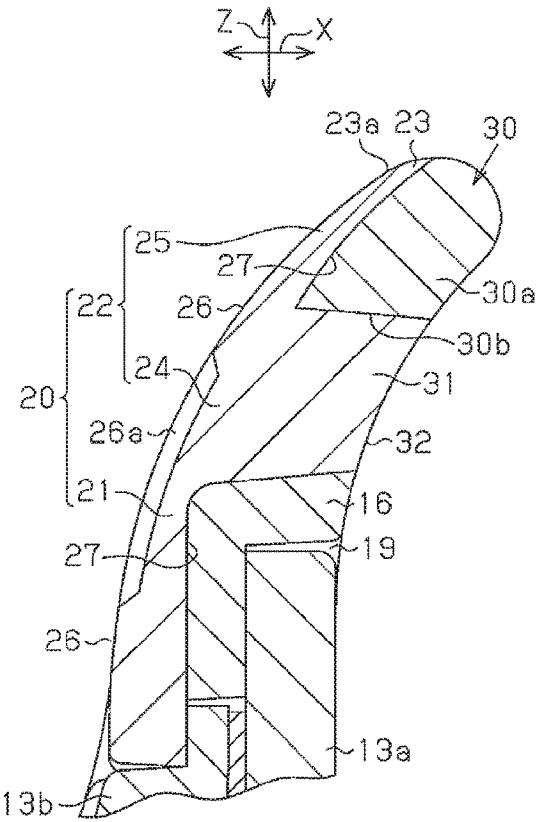
FIG. 6B is a partially enlarged longitudinal sectional view showing only an upper shaving aid in FIG. 6A.
Figure 6A:
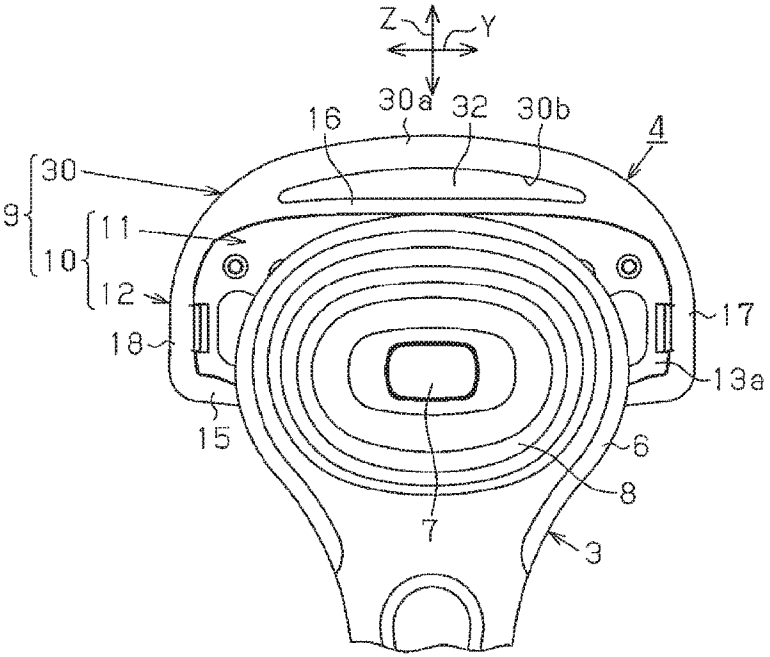
FIG. 6A is a partially enlarged back view showing a top portion of a holder and a razor head in a pivoting razor according to a third embodiment.
Figure 7B:
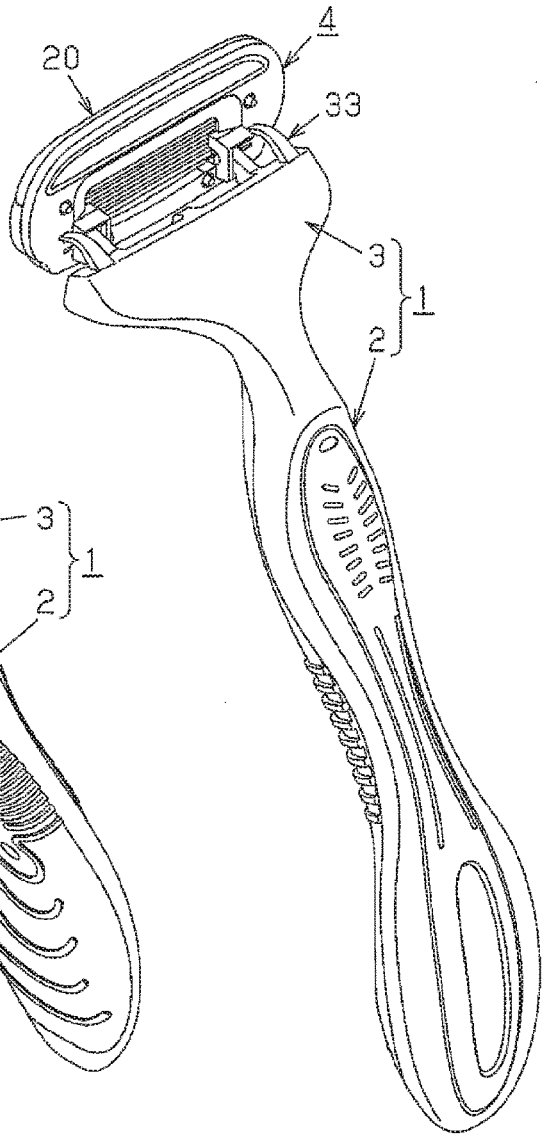
FIG. 7B is an overall perspective view of the same as viewed from the back.
Figure 7A:
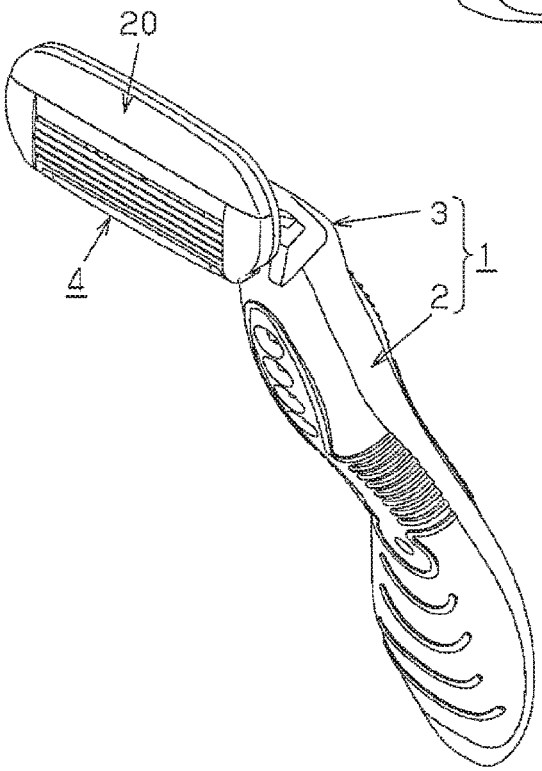
FIG. 7A is an overall perspective view of a neutral position of a razor head in a pivoting razor according to a fourth embodiment as viewed from the front.
Figure 8B:
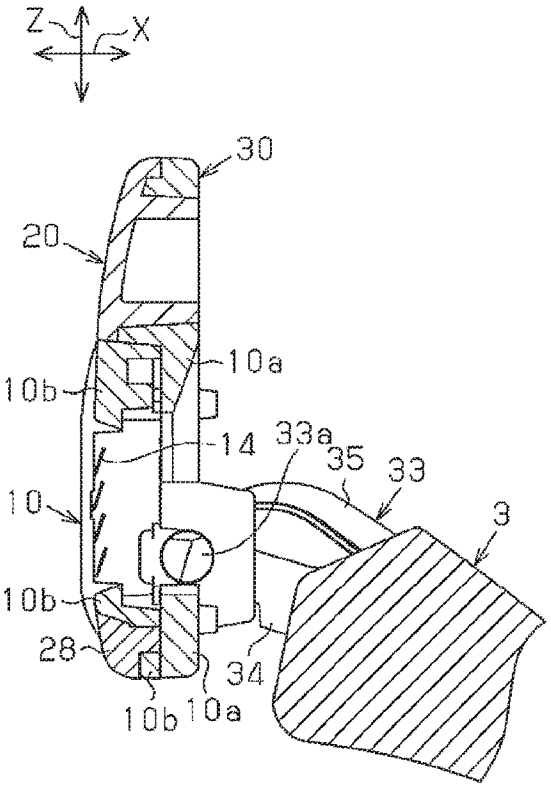
FIG. 8B is a partially enlarged sectional view of the same as viewed from the side.
Figure 8A:
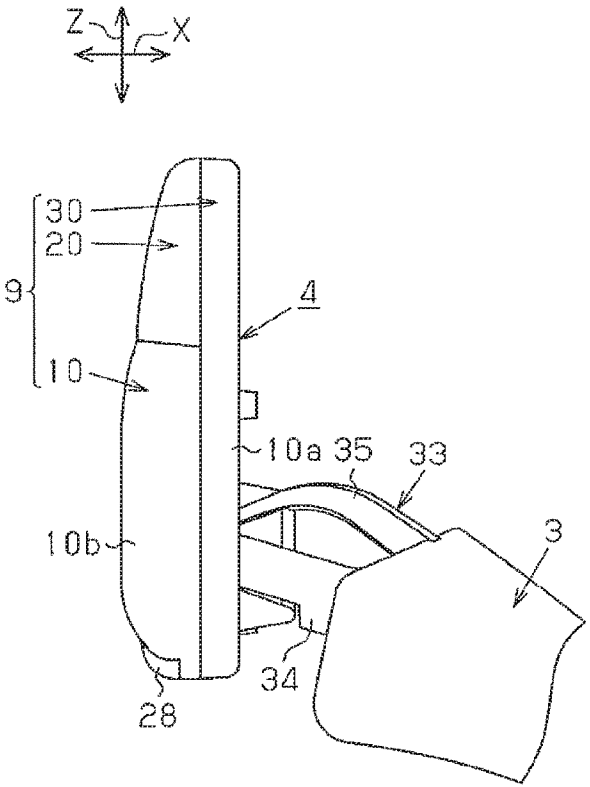
FIG. 8A is a partially enlarged side view showing a top portion of a holder and the razor head in the pivoting razor shown in FIGS. 7A and 7B.
Figure 9A:
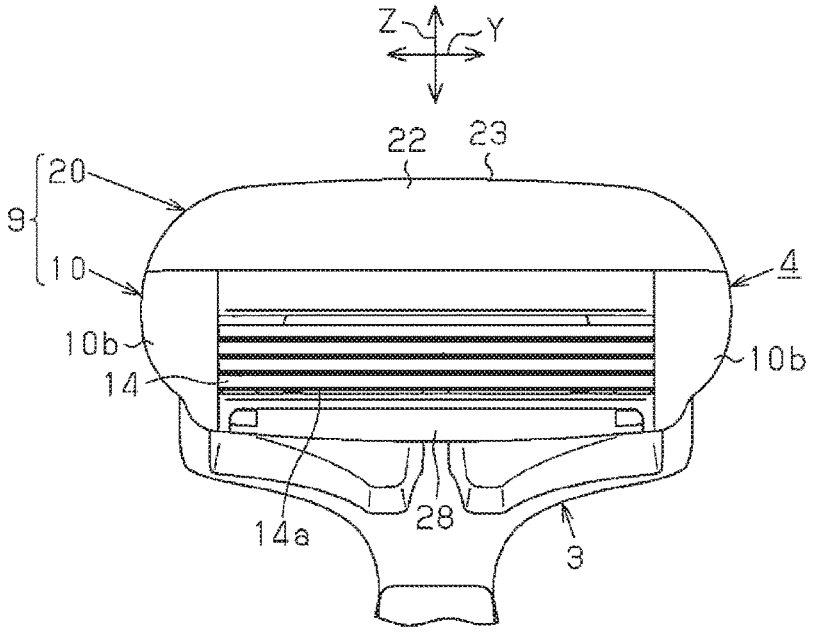
FIG. 9A is a partially enlarged front view showing the top portion of the holder and the razor head in the pivoting razor shown in FIGS. 7A and 7B.
Figure 9B:
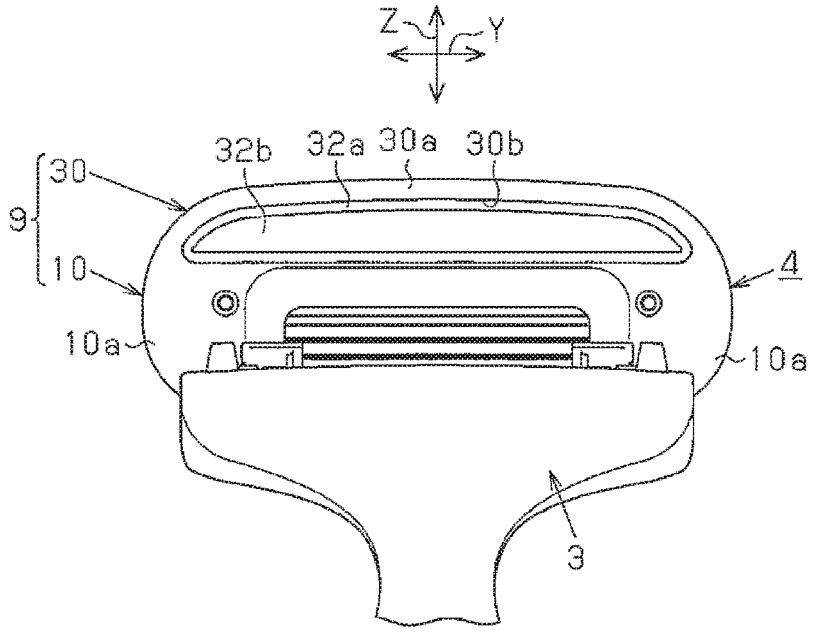
FIG. 9B is a partially enlarged back view of the same.

A third embodiment shown in FIGS. 6A and 6B mainly differs from the first embodiment in that a placement portion 30 supporting the back surface 27 of the deformable portion 22 is integrally protruded from the upper outer frame portion 16. The placement portion 30 is provided with a band portion 30*a* extended from the upper outer frame portion 16 on either side in the extending direction Y of the cutting edges 14*a*, and a retaining hole 30*b* is formed along the band portion 30*a* between the band portion 30*a* and the upper outer frame portion 16. A protrusion 31 inserted and attached in the retaining hole 30*b* is molded to the deformable portion 22, and an end face 32 of the protrusion 31 is exposed to the back side of the placement portion 30. In the third embodiment, the radius of curvature of the front surface 26 of the deformable portion 22 is set to about 10 mm, which is within a preferred range from 5 to 20, while it is about 30 mm, which is within the preferred range from 20 to 100 mm, in the first embodiment and second embodiment. Thus, the degree of curvature of the front surface 26 in the third embodiment is larger than that of the front surface 26 in the first and second embodiments. Further, a partially enlarged front view showing the top portion 3 of the holder 1 and the razor head 4 is identical to FIG. 3A in the first embodiment.

A fourth embodiment shown in FIGS. 7A, 7B to 9A, 9B, and 4B mainly differs from the first embodiment in that the razor head 4 is attached on the front side of the top portion 3, which is located at the upper end of the grip portion 2 in the holder 1, by means of a pivot mechanism 33 having a support arm 34 and a leaf spring 35 and in that the razor head 4 may take a pivoted position vertically tilted about a turning center shaft 33*a* located at a distal end portion of the support arm 34.

A blade support 10 corresponding to the blade support 10 having the main body portion 11 and frame body portion 12 in the first embodiment differs from the first embodiment in that a plurality of blade bodies 14 are assembled between a base portion 10*a* and a covering portion 10*b* and in that a placement portion 30 supporting the back surface 27 of the deformable portion 22 is integrally protruded from the upper side of the base portion 10*a* of the blade support 10.

The placement portion 30 is provided with a band portion 30*a* extended from an attachment portion 16, which is an upper side portion of the base portion 10*a*, on either side in the extending direction Y of the cutting edges 14*a*, and a retaining hole 30*b* is formed along the band portion 30*a* between the band portion 30*a* and the attachment portion 16. A protrusion 31 inserted and attached in the retaining hole 30*b* is molded to the deformable portion 22, and an end face 32 of the protrusion 31 is exposed to the back side of the placement portion 30. To the end face 32, a recess 32*b* is formed inside an annular portion 32*a* along an inner edge of the retaining hole 30*b*. The shaving aid 28 is integrally attached to a lower side portion of the covering portion 10*b* by injection molding. In the present embodiment, the radius of curvature of the front surface 26 of the deformable portion 22 is set to about 40 mm, which is within a preferred range from 20 to 200 mm.

The blade body assembling portion 9 of the razor head 4 is set to have a maximum size in the left-right direction Y of about 44 mm and a maximum size in the vertical direction Z of about 24 mm in the first to third embodiments and to have a maximum size in the left-right direction Y of about 46 mm and a maximum size in the vertical direction Z of about 20.5 mm in the fourth embodiment. In the first embodiment, the deformable portion 22 of the shaving aid 20 is set to have a thickness around the base 24 on the order of 4 mm and have a thickness around the tip portion 25 on the order of 2.5 mm and is made gradually thinner from the base 24 to the tip portion 25. In the second embodiment shown in FIG. 5B, the deformable portion 22 is set to have a thickness around the base 24 on the order of 4 mm and to have a thickness around the tip portion 25 on the order of 1.5 mm so that the tip portion 25 becomes sharply thinner from the base 24 through the step portion 29 in the second embodiment.

The present embodiments have the following advantages.

(1) In the pivotal blade body assembling portion 9 according to the first to fourth embodiments, the deformable portion 22 of the shaving aid 20 including the elastic material is restored after being bent under a bending force as the deformation force or restored after being dented under a compressive force, thereupon lessening shaving resistance due to contact between the shaving aid 20 and the skin surface during use. Accordingly, the tactile sensation on the skin surface is improved to improve the shaving sensation, and also the support structure of the shaving aid 20 is simplified.

(2) In the pivotal blade body assembling portion 9 according to the first and second embodiments, the deformable portion 22 of the shaving aid 20 is provided in a cantilever manner to allow for bending in the thickness direction X of the shaving aid 20. Therefore, the deformable portion 22 is bent more easily in response to the shaving resistance due to contact with the skin surface during use, and the tactile sensation on the skin surface is further improved to improve the shaving sensation.

(3) In the pivotal blade body assembling portion 9 according to the first to fourth embodiments, there is no need to provide a frame portion supporting the protruding edge portion 23 of the deformable portion 22, and the protruding edge portion 23 of the deformable portion 22 and the front surface 26 are exposed to the outside. Thus, the deformable portion 22 is easily deformed when the protruding edge portion 23 and the front surface 26 contact the skin surface. The tactile sensation on the skin surface is further improved to improve the shaving sensation.

Other than the foregoing embodiments, the present invention may be modified as follows, for example.

The shaving aid 20 is protruded upward from the upper outer frame portion 16 of the blade support 10 in the direction Z, which is orthogonal to the thickness direction X of the shaving aid 20 and also orthogonal to the extending direction Y of the cutting edge 14*a* of each blade body 14, in each of the foregoing embodiments. The configuration related the shaving aid 20 (see FIG. 8B) may be applied to the shaving aid 28, so that the shaving aid 28 may be protruded downward from the lower outer frame portion 15 of the blade support 10. Further, the shaving aid 20 may be protruded from the left outer frame portion 17 or the right outer frame portion 18 or both of the left and right outer frame portions 17, 18 in a direction orthogonal to the thickness direction X of the shaving aid 20 and in the extending direction Y of the cutting edges 14*a* of the blade bodies 14.

A flexible portion may be formed on the front surface 26 of the shaving aid 20 to be easily deformed in the thickness direction X, in each of the foregoing embodiments.

The pivot mechanism 5 may be omitted and the razor head 4 may be supported non-pivotally with respect to the top portion 3 of the holder 1 in each of the foregoing embodiments.

The shaving aid 28 of the razor head 4 may be omitted in each of the foregoing embodiments.

The recess 26*a* may be omitted on the front surface 26 of the shaving aid 20 in each of the foregoing embodiments. Instead of the recess 26*a*, the marking may be made by a protrusion.

In the blade support 10 of the foregoing first to third embodiments, the main body portion 11 is non-detachably fitted to the frame body portion 12. However, the main body portion 11 may be detachably fitted to the frame body portion 12.

In the razor head 4 of the foregoing first to third embodiments, the shaving aid 20 may be covered partially or entirely with the cap 4*a*.

The razor head 4 is non-detachably attached to the holder 1 in the foregoing first to fourth embodiments. However, the razor head 4 may be detachably attached to the holder 1 to be replaceable.

In the foregoing first and second embodiments, the razor head 4 pivots or the deformable portion 22 of the shaving aid 20 is bent in response to the shaving force applied to the razor head 4 during use. However, it can be set such that one of the pivoting of the razor head 4 and the bending of the deformable portion 22 occurs prior to the other or the pivoting and the bending occur simultaneously.

When the shaving aid 20 is attached to the blade support 10, the shaving aid 20 may be, for example, fitted or bonded to the blade support 10 in addition to being integrally molded by injection molding in the foregoing first to fourth embodiments. The frame body portion 12 may be molded of the material used for the shaving aid 20, so that a part thereof constitutes the shaving aid 20, and the main body portion 11 may be fitted into the frame body portion 12.

DESCRIPTION OF REFERENCE SIGNS

1 . . . holder, 2 . . . grip portion of holder, 3 . . . top portion of holder, 4 . . . razor head, 5 . . . pivot mechanism, 9 . . . blade body assembling portion of razor head, 10 . . . blade support of blade body assembling portion, 14 . . . blade body, 14*a* . . . cutting edge, 16 . . . outer frame portion (attachment portion) of blade support, 20 . . . shaving aid, 22 . . . deformable portion of shaving aid, 23 . . . protruding edge portion of deformable portion, 24 . . . base of deformable portion, 25 . . . tip portion of deformable portion, 26 . . . front surface of deformable portion, 27 . . . back surface of deformable portion, 29 . . . step portion of deformable portion, Z . . . protruding direction of shaving aid, X . . . thickness direction of shaving aid, Y . . . extending direction of cutting edge.

The invention claimed is:

1. A razor with a shaving aid, comprising a blade body assembling portion provided with a blade support, which supports a blade body, and a shaving aid, wherein the blade support has an attachment portion, to which the shaving aid is attached, the blade support has a front side and a back side that is opposite to the front side, the shaving aid protrudes from the attachment portion, the shaving aid is provided with a deformable portion, which is deformable along with contact with a skin surface during use, and the deformable portion has a protruding edge portion, which is exposed outward in the protruding direction of the shaving aid; and wherein the razor further comprises a holder having a grip portion and a top portion located at an upper end of the grip portion, the blade body assembling portion is attached pivotally to the top portion of the holder, and the top portion of the holder has a front side and a back side that is opposite to the front side of the top portion, and the front side of the top portion faces the back side of the blade support, the top portion of the holder is curved from the front side to the back side, the deformable portion of the shaving aid has a front side, a back side, a front surface located on the front side, and a back surface located on the back side, and the back side of the deformable portion is opposite to the front side of the deformable portion, the front and back surfaces of the deformable portion are exposed in a thickness direction, which is orthogonal to the protruding direction of the shaving aid, and the front surface of the deformable portion is continuous with the protruding edge portion on a front side of the razor, a cutting edge of the blade body is exposed in the blade support on the front surface of the blade support in the thickness direction, the back surface of the deformable portion is continuous with the protruding edge portion on the back side of the deformable portion, and is exposed in the thickness direction, the blade body assembling portion includes a placement portion, the placement portion supports the back surface of the deformable portion, and the placement portion protrudes from the attachment portion of the blade support, the front surface of the deformable portion is curved to approach the back surface of the deformable portion as the distance from the protruding edge portion decreases, the distance between the protruding edge portion of the deformable portion and the attachment portion of the blade support is set narrower toward both sides of the cutting edge of the blade body in an extending direction of the cutting edge, the placement portion is provided with a band portion extended from the attachment portion on either side in the extending direction of the cutting edges, and a retaining hole is formed along the band portion between the band portion and the attachment portion, a protrusion inserted and attached in the retaining hole is molded to the deformable portion, and an end face of the protrusion is exposed to the back side of the placement portion, and the protruding edge portion is provided with a chamfered portion on the front surface of the deformable portion.

2. The razor with the shaving aid according to claim 1, wherein the deformable portion of the shaving aid includes an elastic material.

3. The razor with the shaving aid according to claim 1, wherein the protruding direction of the shaving aid is orthogonal to a thickness direction of the shaving aid and is along an extending direction of the cutting edge of the blade body or a direction orthogonal to the extending direction of the cutting edge.

4. The razor with the shaving aid according to claim 1, wherein the attachment portion of the blade support is provided opposite to the cutting edge of the blade body.

5. The razor with the shaving aid according to claim 1, wherein the front surface of the deformable portion is provided with a recess.

* * * * *